US006602375B2

(12) United States Patent
Marschke

(10) Patent No.: US 6,602,375 B2
(45) Date of Patent: Aug. 5, 2003

(54) SINGLE FACER DRIVE APPARATUS

(76) Inventor: Carl R. Marschke, W5718 County Rd. H, Phillips, WI (US) 54555

( * ) Notice: Subject to any disclaimer, the term of this patent is extended or adjusted under 35 U.S.C. 154(b) by 37 days.

(21) Appl. No.: 09/973,112

(22) Filed: Oct. 9, 2001

(65) Prior Publication Data

US 2003/0066590 A1 Apr. 10, 2003

(51) Int. Cl.[7] ..... B31F 1/28
(52) U.S. Cl. ..... 156/205; 156/470; 156/472
(58) Field of Search ..... 156/205, 210, 156/209, 470, 471, 472, 473; 264/286, 287; 493/463; 425/369, 336; 72/196

(56) References Cited

U.S. PATENT DOCUMENTS 4,627,831 A 12/1986 Hirakawa et al.
4,629,526 A 12/1986 Kanda
4,631,109 A 12/1986 Hirakawa et al.
4,738,744 A 4/1988 Saller
4,773,963 A 9/1988 Seki et al.
4,814,038 A 3/1989 Hayashi et al.
5,628,865 A 5/1997 Marschke
5,951,816 A 9/1999 Marschke
6,012,501 A 1/2000 Marschke

*Primary Examiner*—Michael W. Ball
*Assistant Examiner*—Barbara J. Musser
(74) *Attorney, Agent, or Firm*—Andrus, Sceales, Starke & Sawall

(57) ABSTRACT

A corrugator single facer of the type utilizing a large diameter bonding and corrugating roll and a small diameter corrugating roll is driven without direct drive applied to either corrugating roll. Instead, the pressure belt arrangement which supports the lower corrugating roll to provide the nipping force includes a series of driven supporting pressure belts that are loaded against the lower corrugating roll and which transmit rotational movement thereto and through the nip to the large diameter bonding roll.

8 Claims, 5 Drawing Sheets

SINGLE FACER DRIVE APPARATUS

FIELD OF THE INVENTION

The invention pertains to a single facer apparatus for forming a single face web of corrugated paperboard. More particularly, the invention relates to a corrugating roll assembly comprising a large diameter corrugating roll (i.e. a bonding roll) and a small diameter corrugating roll in which the support arrangement for the small diameter roll is also utilized to drive the corrugating roll pair.

BACKGROUND OF THE INVENTION

In the manufacture of corrugated paperboard, a single facer apparatus is used to corrugate the medium web, to apply glue to the flute tips on one face of the corrugated medium web, and to bring a liner web into contact with the glued flute tips of the medium web with the application of sufficient heat and pressure to provide an initial bond. For many years, conventional single facers have typically included a pair of fluted corrugating rolls and a pressure roll, which are aligned so that the axes of all three rolls are generally coplanar. The medium web is fed into a corrugating nip formed by the interengaging corrugating rolls. While the corrugated medium web is still on one of the corrugating rolls, adhesive is applied to the flute tips by a glue roll. The liner web is immediately thereafter brought into contact with the adhesive-coated flute tips and the composite web then passes through the nip formed by the corrugating roll and the pressure roll.

In the past, the fluted corrugating rolls have typically been generally the same size. More recently, a significantly improved single facer apparatus has been developed in which the corrugating rolls comprise a large diameter bonding roll and a substantially smaller diameter roll, with the ratio of diameters being 3:1 or greater. Such apparatus is disclosed in U.S. Pat. Nos. 5,628,865, 5,951,816, and 6,012,501, all which disclosures are incorporated herein by reference. In accordance with these disclosures, the single facer typically includes a backing arrangement for the small diameter corrugating roll. One preferred backing arrangement includes a series of axially adjacent pairs of backing idler rollers, each pair having a backing pressure belt entrained therearound. Each of the pressure belts is positioned to bear directly against the fluted surface of the small diameter corrugating roll on the side of the small corrugating roll opposite the corrugating nip. Each pair of associated idler rolls and pressure belts is mounted on an actuator, and can thus engage the small diameter corrugating roll with a selectively adjustable force. The application of force against the small diameter corrugating roll, in turn, applies force along the corrugating nip between the small diameter roll and the large diameter roll and along the full length of the nip. Typically, a force of approximately 100 lbs. per linear inch (e.g. 10,000 lbs. for a 100 inch roll) is desirable for properly fluting a medium web at typical line speeds.

In my co-pending application Ser. No. 10/000,514, filed on Oct. 23, 2001 and entitled "Single Facer with Quick Change Rolls", a single facer apparatus is disclosed in which three matching pairs of large diameter and small diameter corrugating rolls may be easily interchanged. In that apparatus, the interchangeable large diameter corrugating rolls are carried on a rotatable turret and the small diameter corrugating rolls are supplied from a storage magazine positioned laterally offset from the turret and the single facer machine. Because the large diameter corrugating rolls also function as heated bonding rolls, they are supplied with steam and must also be provided with a facility to collect and return the condensate. The large diameter bonding roll is typically directly driven and, in my improved apparatus with three large diameter bonding rolls mounted on a turret, driving the single facer with a direct drive to the large diameter bonding roll provides a complicated and challenging engineering problem. Likewise, an attempt to provide a direct drive to the small diameter corrugating roll, which has to be replaced to match the repositioning of a new large diameter bonding roll, would also be complex and difficult.

Thus, some other means of driving the single facer corrugating rolls would be most desirable.

SUMMARY OF THE INVENTION

In accordance with the present invention, the pressure belt arrangement for supporting the small diameter corrugating roll also provides rotatable drive to the small diameter roll from which driving rotation is transmitted through the nip to the large diameter corrugating roll.

In a single facer apparatus in which a single face corrugated web is formed, which apparatus includes a large diameter fluted corrugating roll, a small diameter fluted corrugating roll that is positioned to interengage the large diameter roll to create a corrugating nip, a plurality of backing roll arrangements positioned in operative rotatable engagement with the small diameter corrugating roll, each of which backing roll arrangements includes pairs of backing rolls mounted on a support assembly and a pressure belt entrained around each pair of backing rolls, and an actuator arrangement that is operatively connected to the support assemblies to impose a variable backing force on the backing roll arrangements to force the pressure belts into contact with the small diameter corrugating roll; the improvement provided by this invention comprises a drive arrangement that includes a common drive connection to one of the rolls of each backing roll pair; a source of motive power operatively connected to the drive connection to rotatably drive the commonly connected backing rolls; and, said actuator arrangement being operative to transmit a backing force to the pressure belts and the small diameter corrugating roll sufficient to transmit driving rotation from the small diameter roll through the nip to the large diameter corrugating roll.

Preferably, the commonly connected backing rolls are arranged coaxially along a common axis of rotation and the drive arrangement comprises a drive shaft disposed on the common axis and connected to the source of motive power. In this embodiment, the commonly connected backing rolls comprise toothed sheaves fixed to the drive shaft, and the pressure belts are provided with toothed inner faces for driving engagement with the backing rolls. In the preferred embodiment, each of the commonly connected backing rolls supports a plurality of axially adjacent pressure belts. The actuator arrangement preferably comprises an actuator for each of the backing rolls that forms the other of said backing roll pairs.

The method of driving a single facer, in accordance with the present invention, includes the steps of (1) providing one of the rolls of each backing roll pair with a common rotatable drive connection, (2) driving the drive connection to rotatably drive the commonly connected backing rolls and the pressure belts entrained thereon, (3) supporting the backing rolls and pressure belts to apply a selectively variable radial backing force to the small diameter corrugating roll, and (4) applying a radial force sufficient to transmit driving rotation a small diameter corrugating roll and through the nip to the large diameter corrugating roll.

The method preferably includes the steps of mounting the commonly connected backing rolls coaxially on a common axis of rotation, and rotatably interconnecting said commonly connected backing rolls with a drive shaft disposed on the common axis. The method further includes the step of providing the commonly connected backing rolls and the pressure belts with a toothed interface for positive driving engagement. The method further comprises the step of supporting a plurality of axially adjacent pressure rolls on each of said commonly connected backing rolls.

DETAILED DESCRIPTION OF THE PREFERRED EMBODIMENT

Figure 1:
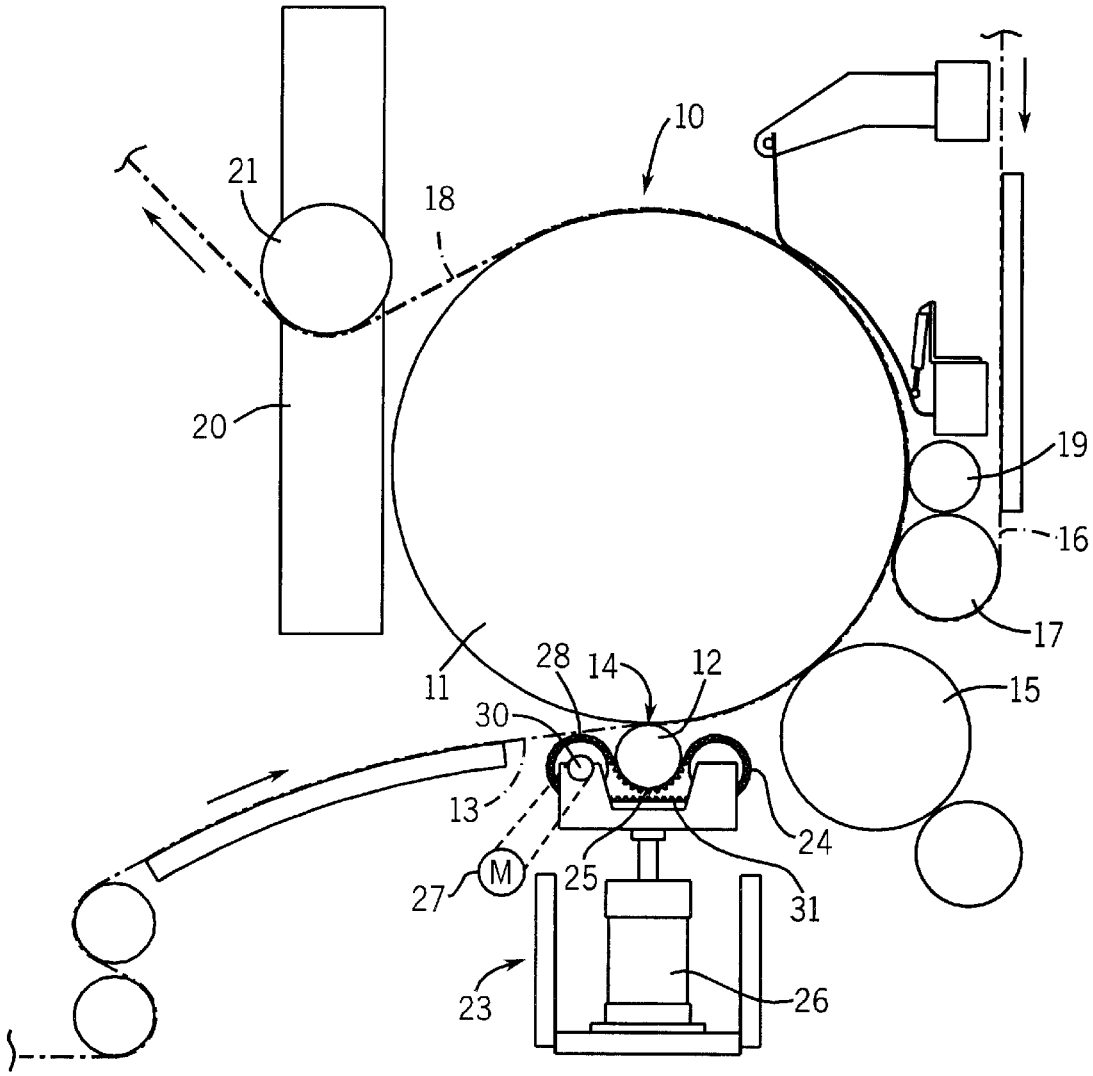
FIG. 1 is a side elevation view of a current state-of-the-art single facer incorporating a corrugating roll drive arrangement of the present invention.
Figure 2:
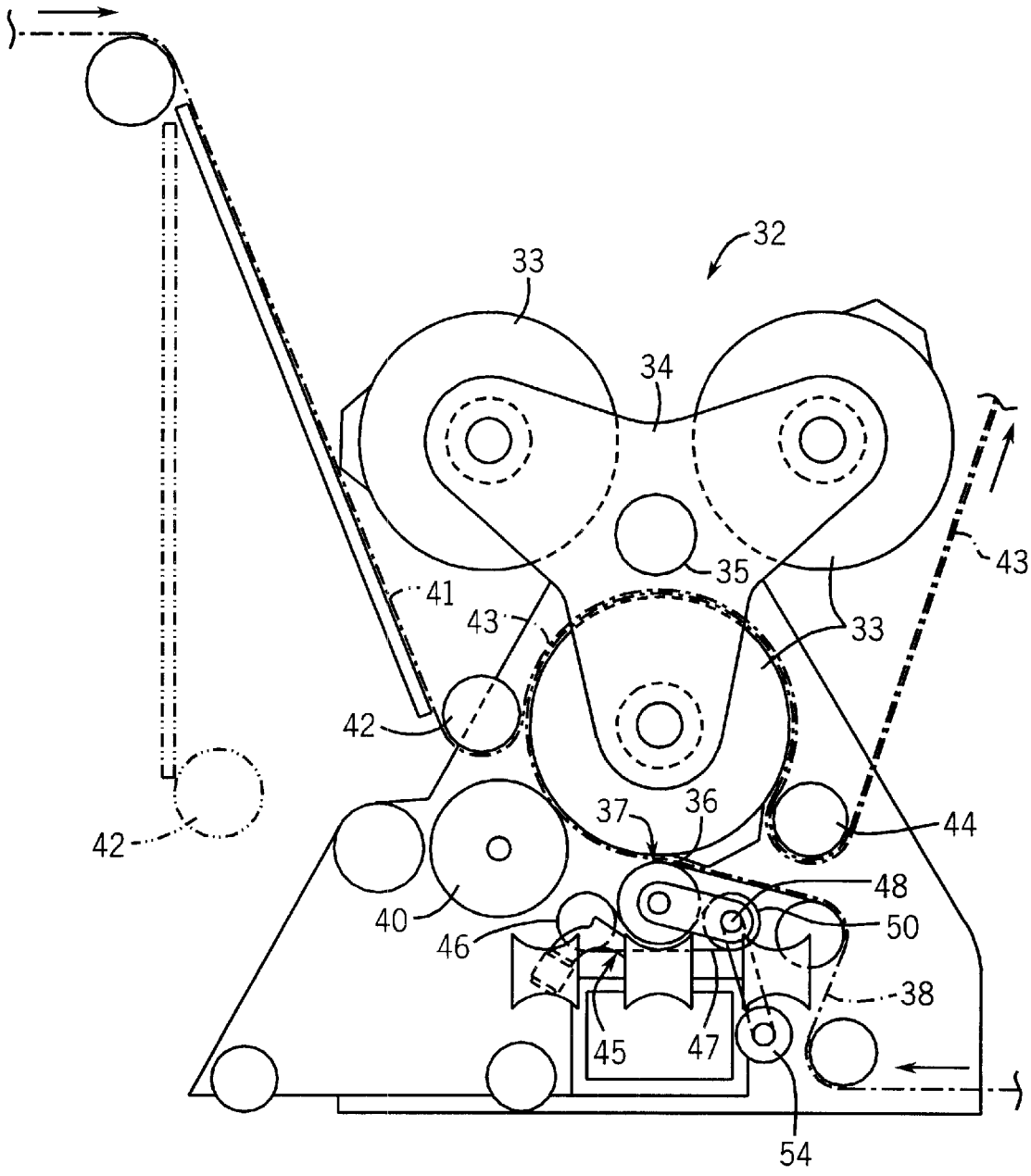
FIG. 2 is a side elevation view of an improved single facer including the drive arrangement of the present invention.
Figure 3:
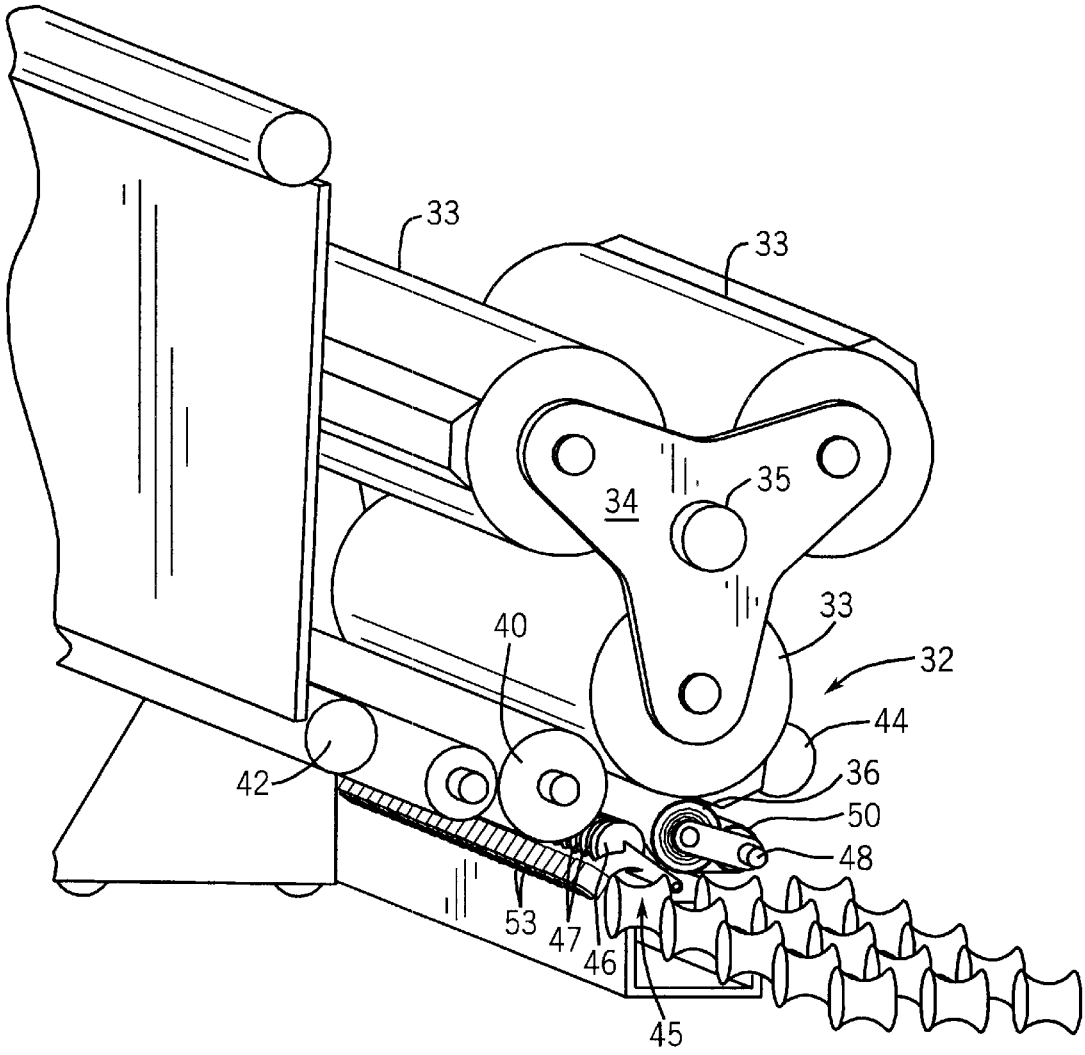
FIG. 3 is an isometric view of the apparatus shown in FIG. 2.

Referring initially to FIG. 1, a single facer 10 includes a large diameter upper corrugating roll 11 (sometimes hereinafter referred to as bonding roll 11) and a much smaller diameter lower corrugating roll 12. Both rolls 11 and 12 may be made of steel or other suitable materials and are fluted and mounted for interengaging rotational movement on parallel axes, all in a manner well known in the art, as described in detail in the above identified patents and patent applications. A medium web 13, which is typically pretreated by moistening and heating, is fed into a corrugating nip 14 formed by the interengaging corrugating rolls 11 and 12. As the corrugated medium web 13 leaves the nip 14, it remains on the surface of the large diameter bonding roll 11. Immediately downstream from the nip 14 a glue roll 15 applies a liquid adhesive, typically starch, to the exposed flute tips of the corrugated medium web 13. Immediately thereafter, a liner web 16 is brought into contact with the glued flute tips of the corrugated medium web by a liner delivery roll 17, sometimes referred to as a generator roll. The resulting freshly glued single face web 18 continues around a portion of the outer circumference of the large diameter bonding roll 11. The initial bond between the medium web 13 and liner web 16 may be assisted with a soft contact roll 19 located immediately downstream from the delivery roll 17. The soft contact roll 19 presses the composite single face web 18 against the bonding roll 11 with a light and uniform force distributed across the full width of the web. Because the large diameter roll 11 also functions as a bonding roll, it is internally heated, for example with steam, to cause the starch adhesive to initially gelatinize and then enter the so-called "green bond" stage. By assuring that green bond is reached while the single face web 18 is still on the bonding roll 11, integrity of the glue lines is better assured and downstream handling, including back wrapping around a wrap roll 21, is not likely to disturb the bond. The extent of the wrap of the single face web 18 on the bonding roll and thus the circumferential residence time of the single face on the bonding roll may be varied by adjustably positioning the wrap roll along a positioning mechanism 20. The vertical position of the wrap roll 21 with respect to the surface of the bonding roll 11 may be selectively adjusted depending on a number of variables, such as paper weight, web speed, bonding roll temperature, starch composition, and the like. Alternately, the position of the wrap roll may be fixed particularly in the preferred embodiment described below with respect to FIGS. 2–5.

In the single facer shown in FIG. 1, the large diameter corrugating and bonding roll 11 typically has a diameter of about 39 inches (about 1,000 mm) and the smaller diameter lower corrugating roll 12 typically has a diameter of about 5 inches (about 130 mm). The prior art identified above and incorporated herein provides various backing arrangements for the small diameter roll 12, one of which backing arrangements 23 is shown in the drawing. The backing arrangement 23 includes a series of axially adjacent pairs of backing rolls 24, each of which pairs has a pressure belt 25 entrained therearound. Each of the pressure belts 25 is positioned to bear directly against the fluted outer surface of the small diameter corrugating roll 12. Each pair of idler rolls 24 and its respective pressure belt 25 is mounted on an actuator 26. By individually controlled operation of each actuator 26, the pressure belts may be made to engage the small diameter corrugating roll 12 with a selectively adjustable force. In current state-of-the-art single facers, the large diameter bonding roll 11 is typically driven by the main drive motor. In accordance with the present invention, however, all of the axially aligned backing rolls 24 on one side of the lower corrugating roll 12 are converted from idler rolls to drive rolls 28. The drive rolls 28 are mounted on a common drive shaft 30, the lateral outer end of which is operatively connected to a main drive motor 27. The drive rolls 28 are provided with a toothed outer surface to cooperate with a correspondingly toothed pressure belt 25 which may be conveniently in the form of a conventional reinforced rubber timing belt 31. By driving the drive rolls 28 together and applying an appropriate backing force to the backing arrangement 23 with the actuators 26, the lower corrugating roll 12 may be suitably driven due to approximately 90° of wrap of pressure belts 25 around the roll 12. The driving force is transmitted through the nip 14 to the bonding roll 11.

Referring now to FIGS. 2–5, there is shown an improved single facer 32 incorporating the unique indirect corrugating roll drive of the present invention in a machine construction in which multiple corrugating roll pairs may be changed to provide different flute patterns. The corrugating roll pair interchange system is described in detail in my co-pending application identified above.

The single facer 32 includes a large diameter bonding roll 33 in operative position and mounted on a rotatable turret 34 with two similar bonding rolls 33. Rotation of the turret 34 on its axis 35 brings a selected one of the bonding rolls 33 into operative position to form a nip 37 with a small diameter corrugating roll 36. The large diameter bonding roll 33 may have a diameter of 22.5 in. (about 570 mm) and the small diameter corrugating roll 36 having a diameter of 7.5 in. (about 190 mm). Each of the large diameter bonding rolls 33 may be provided with a different flute pattern and, for the particular bonding roll chosen and rotated into operative position, the interengaging small diameter corrugating roll 36 must also be changed to one having a corresponding flute pattern.

In a manner similar to the single facer 10 shown in FIG. 1, a medium web 38 is fed into the corrugating nip 37 and, after corrugating, remains on the surface of the bonding roll 33. A starch adhesive is applied to the exposed flute tips of the corrugated medium web 38 on the bonding roll by a glue roll 40 and, immediately thereafter, a liner web 41 is brought into contact with the glued tips of the corrugated medium web delivered by a generator roll 42 to form a single face web 43. By retaining the freshly glued single face web 43 on the heated bonding roll 33 over a substantial extent of its circumference, an adequate green bond is formed in the glue lines such that, when the single face web 43 is taken off the bonding roll as by wrapping around an exit roll 44, the green bond strength is adequate to assure that the bond between the medium web 38 and liner web 41 is not disturbed.

Figure 4:
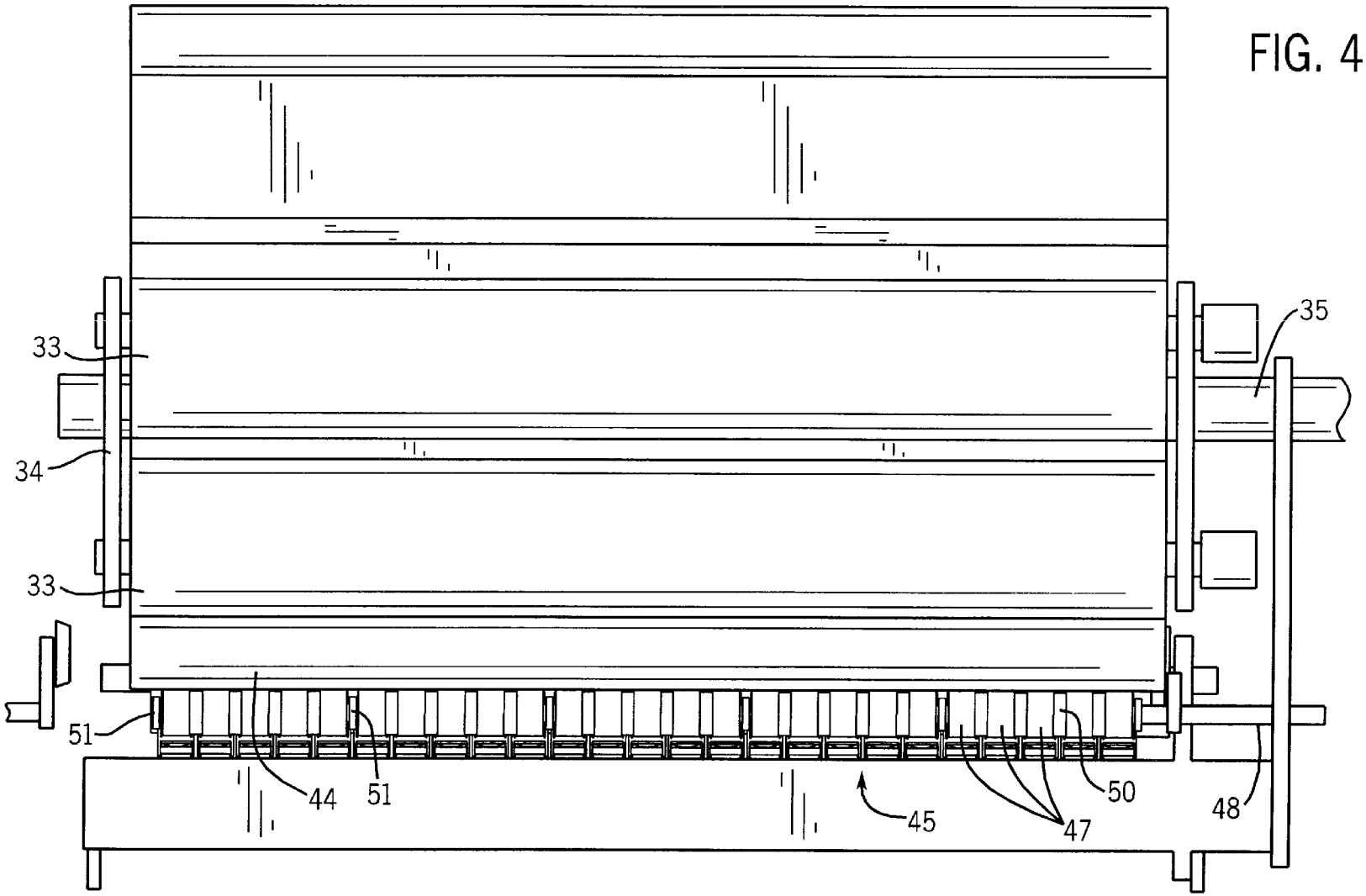
FIG. 4 is a rear elevation view of the single facer shown in FIG. 2.
Figure 5:
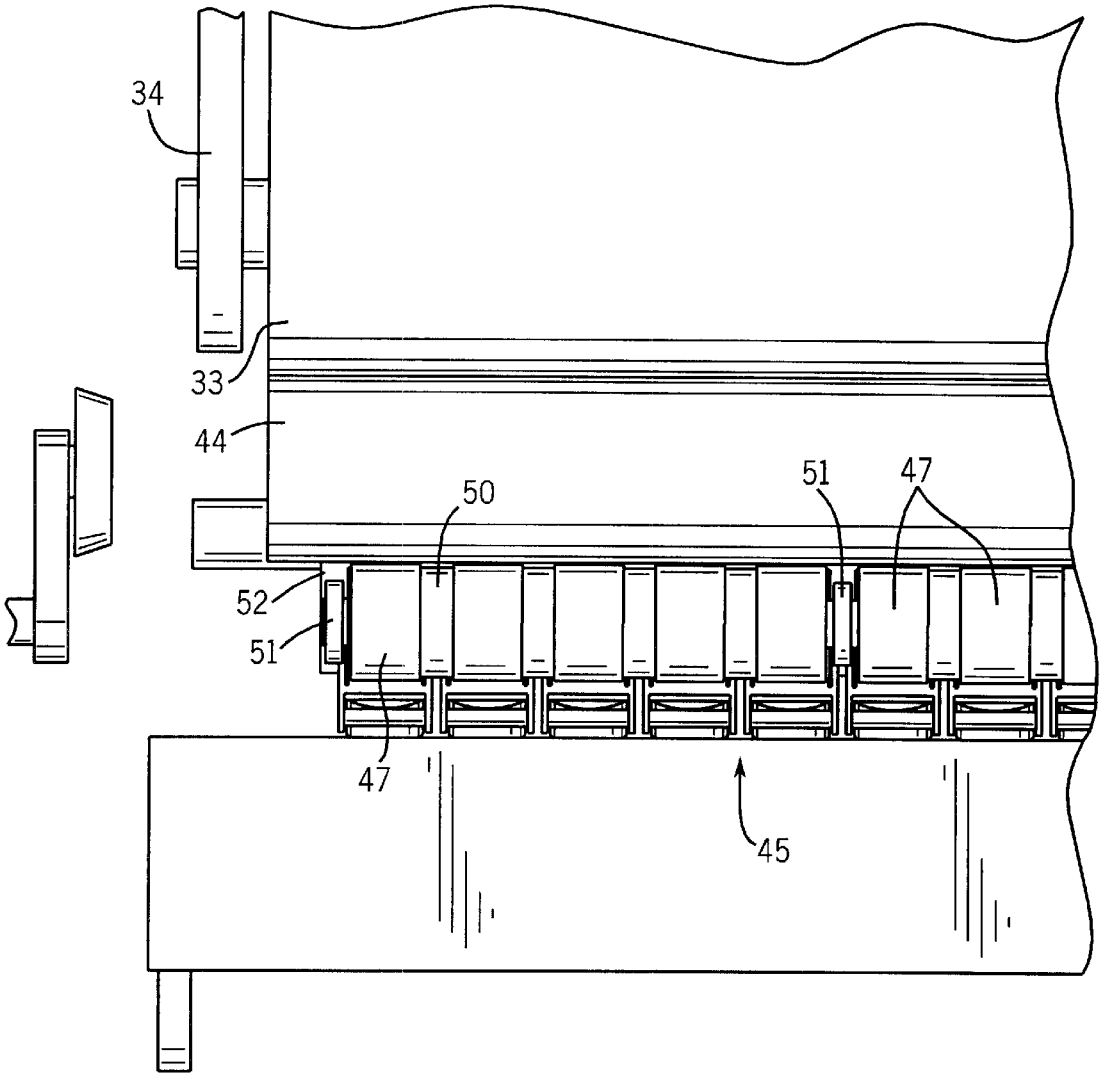
FIG. 5 is an enlarged detail of a portion of the apparatus shown in FIG. 4.

The small diameter corrugating roll 36 is supported to maintain an adequate nipping force and to prevent axial bending of the roll with a backing arrangement 45 that is similar to the backing arrangement 23 of the FIG. 1 embodiment. Thus, pairs of backing rolls 46 are positioned on opposite sides of the small diameter corrugating roll 36 and pressure belts 47 are entrained around the rolls and support the small diameter roll from beneath. However, one axially aligned row of backing rolls is mounted on a drive shaft 48 that extends across and beyond the full width of the machine in the cross machine direction. The rolls are keyed or otherwise fixed to the drive shaft 48 and act as drive rolls 50. Referring also to FIGS. 4 and 5, each drive roll 50 is provided with a toothed outer surface so that it may positively engage and drive pressure belts 47 also having a toothed construction in the manner of a timing belt. Each drive roll 50 is of extended axial length so that it can accommodate more than one pressure belt 47. In the embodiment shown, the drive roll 50 has an axial length adequate to carry five adjacent pressure belts. Between each drive roll 50 and at the outer ends of the two outermost drive rolls, the drive shaft 48 is supported in bearings 51 conveniently mounted in split hanger brackets 52 to facilitate removal of the drive shaft and drive rolls to change the pressure belts 47.

The opposite row of backing rolls 46 may be comprised of the same idler rolls 24 described with respect to the FIG. 1 embodiment, each carrying a single pressure belt 47. In other words, each drive roll 50, carrying five pressure belts 47, will be interconnected thereby with five backing rolls 46.

The backing arrangement 45 of this embodiment also differs from the FIG. 1 embodiment in the manner in which the backing force on the small diameter corrugating roll 36 is applied. Because it is necessary or at least highly desirable not to move the axis of the drive shaft 48 and drive rolls 50, the backing arrangement 45 is arranged to mount each backing roll 46 on its own pivot arm 49 and to place the loading actuators 53 below each of the backing rolls 46 and in operative engagement with the pivot arms. The actuators 53 may comprise pneumatic cylinders, air bags, or any other suitable device. In operation, the actuators 53 are extended to pivot the arms 49 and backing rolls 46 upwardly around the common axis of the opposite ends of the arms 49, causing the pressure belts 47 to load the small diameter corrugating roll 36 against the bonding roll 33 at the nip 37. The main drive motor 54 is operatively connected to one outer end of the drive shaft 48 (see FIG. 2), whereby the drive rolls 50 impart driving rotation to the backing rolls 46 and pressure belts 47. Pressure belt movement imparts rotation to the small corrugating roll 36 which is transmitted through the nip to the bonding roll 33 causing it to rotate with the small corrugating roll.

I claim:

1. In a single facer apparatus for forming a single face corrugated web, including a large diameter fluted corrugating roll; a small diameter fluted corrugating roll positioned to interengage the large diameter roll to create therewith a corrugating nip through which a medium web is fed; a plurality of backing roll arrangements positioned along the axial length of and in operative rotatable engagement with the small diameter corrugating roll, each backing roll arrangement including pairs of backing rolls mounted on a support assembly and a pressure belt entrained around each pair of backing rolls; and, an actuator arrangement operatively connected to the support assemblies to impose a variable backing force on backing roll arrangements to force the pressure belts into contact with the small diameter corrugating roll; the improvement comprising:

a drive arrangement including a common drive connection to one roll of each backing roll pair;

a source of motive power operatively connected to the drive connection to rotatably drive said commonly connected backing rolls; and, said actuator arrangement operative to transmit a backing force to the pressure belts and the small diameter corrugating roll sufficient to transmit driving rotation from the belts to the small diameter roll and through the nip to the large diameter corrugating roll.

2. The apparatus as set forth in claim 1 wherein said commonly connected backing rolls are arranged coaxially along a common axis of rotation and said drive arrangement comprises a drive shaft disposed on said common axis connected to the source of motive power.

3. The apparatus as set forth in claim 2 wherein said commonly connected backing rolls comprise toothed sheaves fixed to said drive shaft, and said pressure belts are provided with toothed inner faces for driving engagement with said backing rolls.

4. The apparatus as set forth in claim 3 wherein each of said commonly connected backing rolls supports a plurality of axially adjacent pressure belts.

5. A method of driving a single facer apparatus for producing a single face corrugated web from a medium web and a liner web, the apparatus including a large diameter fluted corrugating roll, a small diameter fluted corrugating roll positioned to interengage the large diameter roll to create therewith a corrugating nip, and, a plurality of pressure belts each entrained between a pair of backing rolls and positioned along the axial length of the small diameter fluted corrugating roll to apply a radial backing force to the small diameter roll along the axial length thereof, the method comprising the steps of:

(1) providing one of the rolls of each backing roll pair with a common rotatable drive connection;

(2) driving said connection to rotatably drive said commonly connected backing rolls and the pressure belts entrained thereon;

(3) supporting the backing rolls and pressure belts to apply a selectively variable radial backing force to the small diameter corrugating roll; and, (4) applying a radial force sufficient to transmit driving rotation to the small diameter corrugating roll and through the nip to the large diameter corrugating roll.

6. The method as set forth in claim 5 including the steps of:

(1) mounting said commonly connected backing rolls coaxially on a common axis of rotation; and, (2) rotatably interconnecting said commonly connected backing rolls with a drive shaft disposed on said common axis.

7. The method as set forth in claim 6 comprising the step of providing said commonly connected backing rolls and said pressure belts with a toothed interface for positive driving engagement.

8. The method as set forth in claim 7 comprising the step of supporting a plurality of axially adjacent pressure belts on each of said commonly connected backing rolls.

* * * * *